US006149342A

United States Patent [19]

Phillips

[11] Patent Number: 6,149,342

[45] Date of Patent: Nov. 21, 2000

[54] ANTI-BRIDGING MECHANISM

[75] Inventor: John F. Phillips, Yukon, Okla.

[73] Assignee: CMI Corporation, Oklahoma City, Okla.

[21] Appl. No.: 09/276,365

[22] Filed: Mar. 25, 1999

[51] Int. Cl.[7] ..... E01C 23/00

[52] U.S. Cl. ..... 404/90; 404/129; 404/91

[58] Field of Search ..... 404/90, 91, 129

[56] References Cited

U.S. PATENT DOCUMENTS

| | | | |
|---|---|---|---|
| 3,085,484 | 4/1963 | McAdams et al. | 404/129 |
| 3,568,778 | 3/1971 | Swisher, Jr. . | |
| 3,612,611 | 10/1971 | Ellis . | |
| 3,637,026 | 1/1972 | Snow . | |
| 3,765,724 | 10/1973 | Hatcher et al. . | |
| 3,779,606 | 12/1973 | Hatcher et al. . | |
| 3,779,608 | 12/1973 | Hatcher et al. . | |
| 3,868,146 | 2/1975 | Ellis . | |
| 3,888,542 | 6/1975 | Gowler . | |
| 3,895,843 | 7/1975 | Wall et al. . | |
| 4,139,318 | 2/1979 | Jakob et al. . | |
| 4,335,921 | 6/1982 | Swisher, Jr. et al. . | |
| 4,786,111 | 11/1988 | Yargici | 404/90 |
| 4,968,099 | 11/1990 | Meiser . | |
| 4,986,604 | 1/1991 | Meiser . | |
| 5,190,398 | 3/1993 | Swisher, Jr. . | |
| 5,287,933 | 2/1994 | Lindblom | 404/90 |
| 5,373,902 | 12/1994 | Lindblom | 404/90 |
| 5,722,789 | 3/1998 | Murray et al. | 404/90 |
| 5,788,755 | 8/1998 | Salminen . | |

OTHER PUBLICATIONS

Caterpiller, CAT RR–250 Road Reclaimer (1987).

Rexworks, Inc., Pulyi–Master Reclaimer & Stabilizer (no date) (1 page).

*Primary Examiner*—James A. Lisehora
*Assistant Examiner*—Alexandra K. Pechhold
*Attorney, Agent, or Firm*—Emrich & Dithmar

[57] ABSTRACT

An anti-clogging or anti-bridging mechanism is disclosed which is structurally arranged to engage the nozzle ports in a cutting housing to seal the ports from pulverized road bed material. The mechanism further includes cable members which facilitate movement of the pulverized material through the cutting housing.

9 Claims, 7 Drawing Sheets

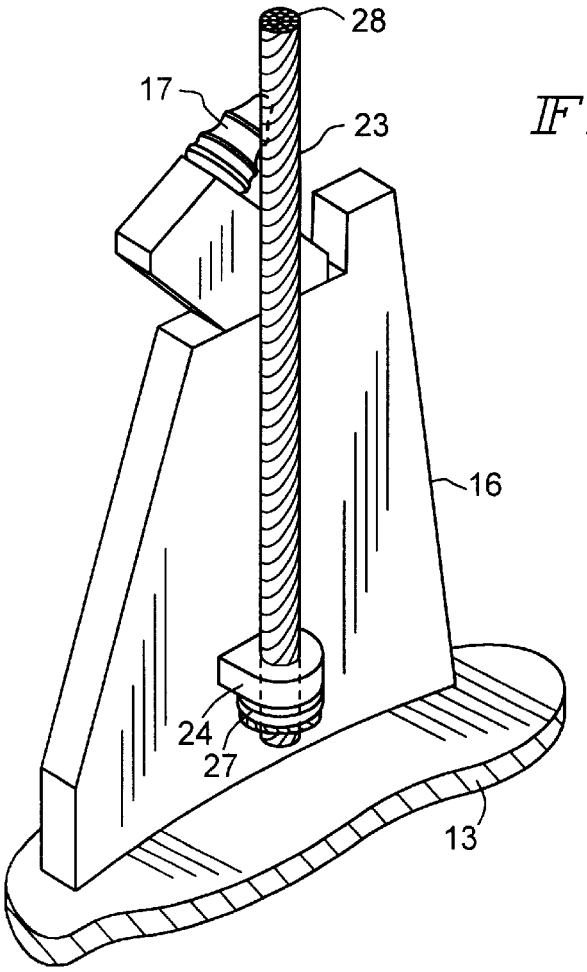
FIG. 5
FIG 6
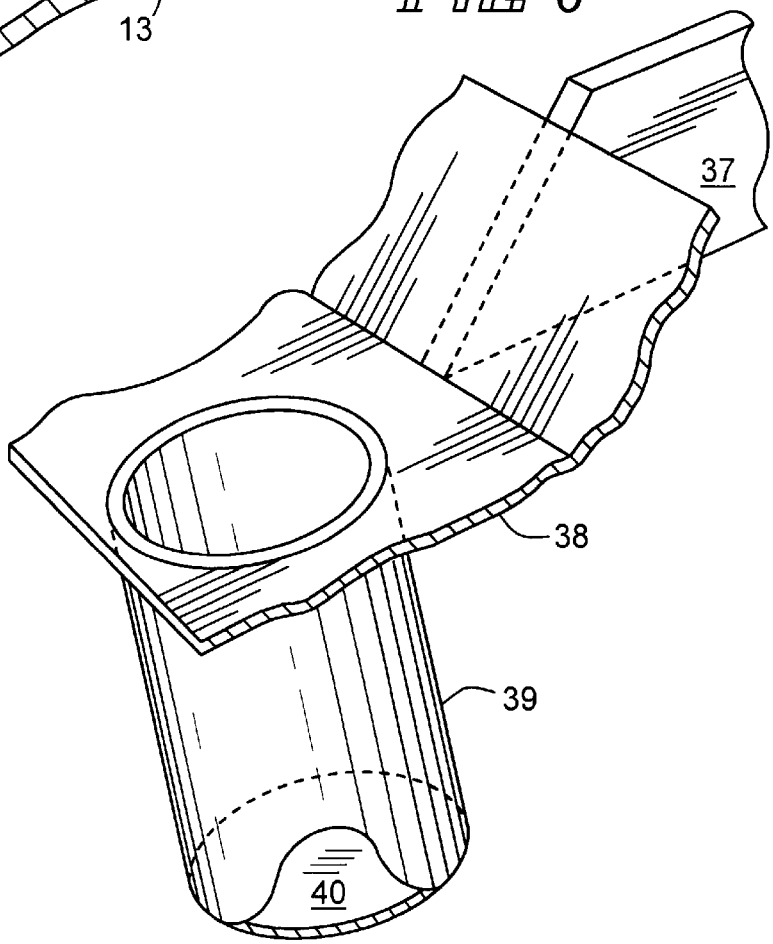

ANTI-BRIDGING MECHANISM

FIELD OF THE INVENTION

The present invention relates to a novel anti-clogging apparatus for use with a reclaimer/stabilizer machine which prevents the build-up of the pulverized road bed material on the interior surface of the cutter housing and prevents the blockage of the nozzle ports by the pulverized road bed material.

BACKGROUND OF THE INVENTION

The use and structure of reclaiming and stabilizing machines is well known. U.S. Pat. No. 5,190,398 describes a reclaimer/stabilizer machine for preparing a new surface material from an existing road bed by the pulverization of the road bed. Such a machine includes a rotating cutter assembly confined within a cutter housing. The cutter housing includes a series of nozzle ports extending across the width of the housing which cooperate with pivotally mounted spray nozzles to permit spraying of liquid additives into the cutter housing to be mixed with the salvaged material being pulverized to provide the desired stabilized road bed. The nozzles spray liquid additives into the cutter housing to achieve a uniform consistency of the desired stabilized surface. As the cutter assembly engages the existing road bed being pulverized, the centrifugal force of the rotating cutters directs the cut and pulverized road bed material upwardly to pack the material against the inside surface of the cutter housing. Also, during this upward cutting action, the nozzle ports are engaged by spray nozzles which spray the liquid additive into the cutting chamber to predeterminely control the composition of the pulverized material. The control of the desired composition necessarily requires periods of time when the liquid additives are not being sprayed into the cutting chamber. During such times of non-spraying, the spray nozzles are pivotally moved away from the nozzle ports and the ports are closed. However, the build-up of the pulverized and sprayed material within the housing covers and bridges over the closed nozzle ports with a layer of pulverized material. When such build-up remains for a period of time over the nozzle ports, the nozzle ports become sealed and closed. When this bridging condition occurs, the build-up material hardens and prevents the spray nozzles from entering the nozzle ports to spray liquid addititive into the cutter housing, as required.

Accordingly, such reclaimer/stabilizer machines require careful maintenance and proper cleaning to maintain the nozzle ports free of build-up and to remove the build-up of the pulverized material within the cutting housing. When it becomes necessary to clean and remove this build-up in the housing and on the nozzle ports, the machine must be stopped and valuable operating time is lost for accomplishing the difficult task of cleaning and opening the ports to permit injection of the liquid additives.

SUMMARY OF THE INVENTION

Accordingly, it is one object of the present invention to provide a novel mechanism which is structurally arranged to cooperate with the nozzle ports to prevent the build-up of the pulverized material within the housing and over the nozzle ports.

It is another object of the present invention to provide a novel cable arrangement which is mounted to the cutter brackets on the cutting drum which facilitates removal and minimizes the formation and build-up of the pulverized road bed within the cutter housing.

It still is another object of the present invention to provide a simple and inexpensive structure for pivotally mounting a series of anti-clogging pockets or anti-bridging cups which penetrate the cutter housing at the nozzle ports and which cooperate with the rotating cable extension members to prevent the build-up of pulverized material within the nozzle ports.

It is yet another object of the present invention to provide a simple and inexpensive structure for the pivotal removal of the series of anti-clogging pockets or anti-bridging cups from the nozzle ports to permit insertion of spray nozzles for injecting liquid additives into the cutter housing.

The present invention relates to an anti-clogging or anti-bridging mechanism which is structurally arranged with respect to a cutting chamber of a reclaimer/stabilizer machine to limit the build-up of the pulverized material within the cutter housing to an acceptable level and to maintain the nozzle ports free of pulverized material build-up. The anti-clogging mechanism assures a clog free structure which permits the insertion of the spraying nozzles into the nozzle port openings, to permit injection of liquid additive to the pulverized material as desired.

The anti-bridging mechanism in accordance with the present invention includes mounting brackets fixedly secured to the exterior wall of the cutting housing. The mounting brackets support a mounting tube having a plurality of lever arms extending therefrom which are secured to an anti-bridging plate which include a series of anti-bridging pockets therein or thereon. The mounting tube further includes an anchor member connected to a cylinder member which is secured to the cutting housing. Upon actuation of the cylinder member, the mounting tube is rotated and the anti-bridging pockets are positioned to enter and to engage the nozzle ports when the nozzles are removed from the ports during the non-spraying condition during usage of the reclaimer/stabilizer machine. Thus, the anti-bridging cups or pockets are moved from an outward disengaged position to an inward engaged position wherein each of the bridging cups extend into the nozzle opening to prevent and block the build-up of the pulverized material within the nozzle opening. During operation of reclaimer/stabilizing machine, alternating use with and without liquid injection into the cutting housing is required. Accordingly, the anti-bridging mechanism in accordance with the present invention prevents the build-up of the pulverized material within the nozzle ports during operation of the reclaimer/stabilizing machine.

When it is desired to add liquid materials to the pulverizing chamber of the cutting housing, the anti-bridging cylinder is engerzied to rotate the mounting tube and move the ganged bridging cups from the engaging position within the nozzle ports to the disengaged position away from the nozzle ports. This movement of the anti-bridging mechanism maintains the nozzle ports in an open condition and permits the movement of the spray nozzles from the disengaged to the engaged position wherein the ganged nozzles cooperate with the nozzle ports to spray liquid additives into the cutter housing, as desired.

In a further embodiment of the present invention, a plurality of cable members are individually secured to the side of selected cutter shanks or brackets extending outwardly and about the periphery of the cutter drum. An individual cable member is adapted and positioned on a predetermined cutter bracket to encounter one of the nozzle ports during each revolution of the cutter drum. Thus, in accordance with the present invention, the nozzle ports are spaced equally across the width of the cutting housing to provide, in one example of the present invention, 16 nozzle ports. The number of cables that are mounted to the cutter shanks or brackets extending radially outwardly from the cutter drum would be a total of 16 cables. The individually mounted cables each cooperate with or encounter one of the anti-bridging pockets that is inserted into a nozzle port on each revolution of the cutting drum. The cable members are mounted to selective cutter brackets in a helical pattern or array.

It is preferred that the cables be so mounted on the cutter bracket that the cables radially extend beyond the peripheral edge of the cutter tool that is mounted to the cutter bracket. The extended cables engage and facilitate movement of the pulverized material about the interior of the cutter housing and prevent build-up of the pulverized material within the cutter housing. It is further desired that the cables be so mounted to the brackets of the cutters spaced about the cutter drum in a helical pattern and that each of the cables be mounted coincidentally with the nozzle ports to permit the individual cables to engage the inserted anti-bridging pocket or cup in the respective nozzle port during each revolution of the cutter drum to limit build-up of the pulverized material within the housing and to maintain the nozzle ports free and clear of material build-up.

Other and further significant objects of the present invention will be apparent from the following described which is illustrated in the accompanying drawings which, by way of illustration, show a preferred embodiment of the present invention and the principles thereof and what are now considered to be the best mode in which I have contemplated applying these principles. Other embodiments of the present invention providing the same or identical equivalent principles may be used and structural changes which may be made as desired by those skilled in the art without departing from the scope of the present invention.

DESCRIPTION OF THE DRAWINGS

For facilitating and understanding the present invention there is illustrated in the accompanying drawings a preferred embodiment thereof, from and inspection of which, when considered in connection with the following description, the invention its construction and operation and many of its advantages will be readily understood and appreciated.

FIG. 5 is an enlarged perspective view illustrating the attachment of an anti-bridging cable member to a cutter tooth shank or bracket in accordance with the present invention;

FIG. 6 is an enlarged partial perspective view of the anti-bridging plate and pocket member which is engagable with a nozzle port in accordance with the present invention;

DETAILED DESCRIPTION

The present invention is illustrated in the accompanying drawings, wherein like numerals have been used throughout the several views to designate the same or similar parts. The present invention relates to pulverizing assembly or apparatus 10 having a anti-clogging or anti-bridging mechanism 30 for use with a reclaimer/stabilizer machine. The anti-bridging mechanism limits and minimizes the build-up of the pulverized road bed material onto the interior surface of the cutter housing 12 and prevents the build-up and closure of the pulverized road bed material over the nozzle or spray ports 20 (FIGS. 3 and 8) during operation of the reclaimer/stabilizer machine.

Figure 1:
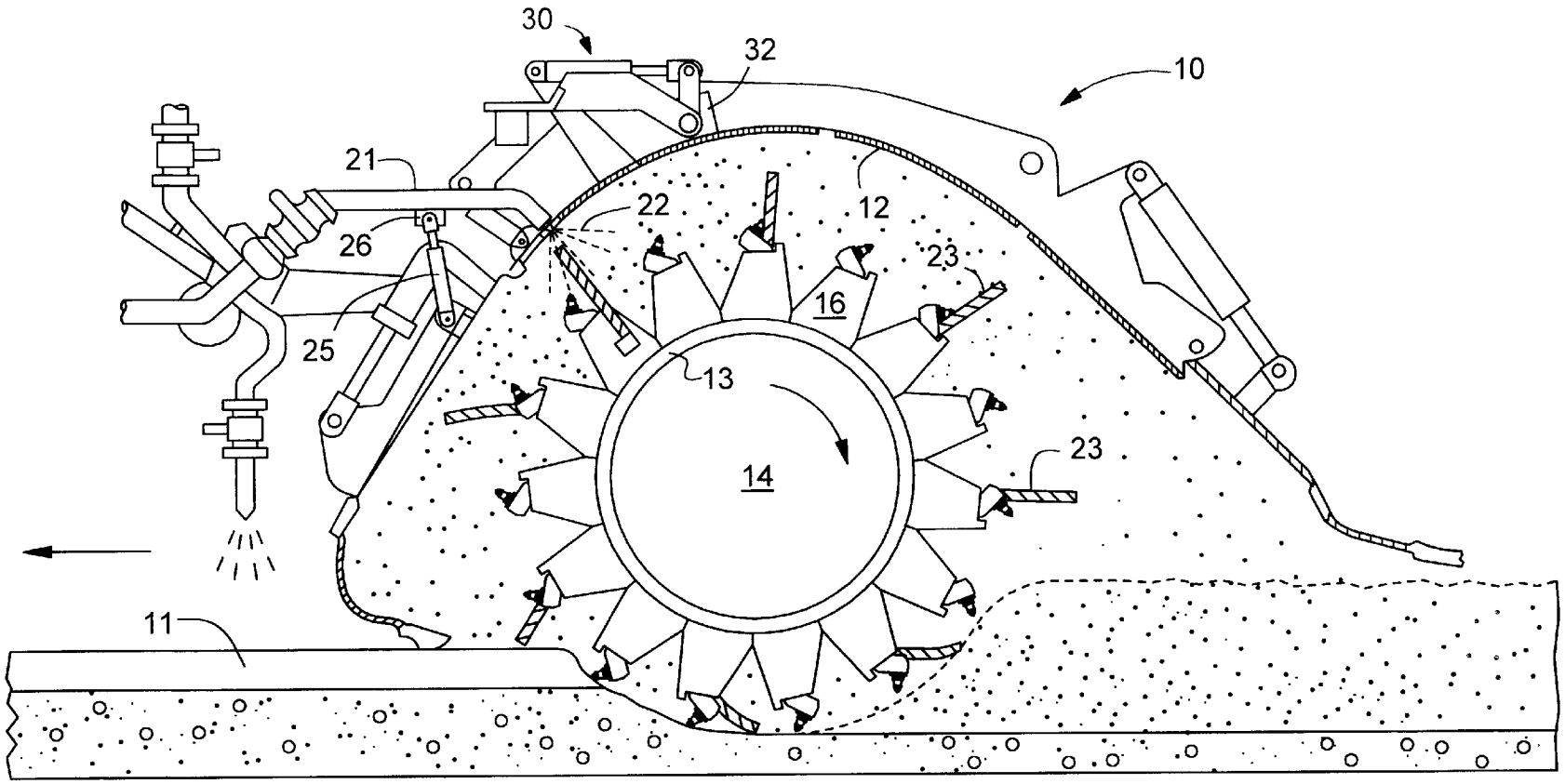
FIG. 1 is a schematic side view of the pulverizing chamber or assembly of a reclaimer/stabilizer machine in accordance with the present invention illustrating the injection of liquid material into the pulverizing assembly during operation of the machine.
Figure 2:
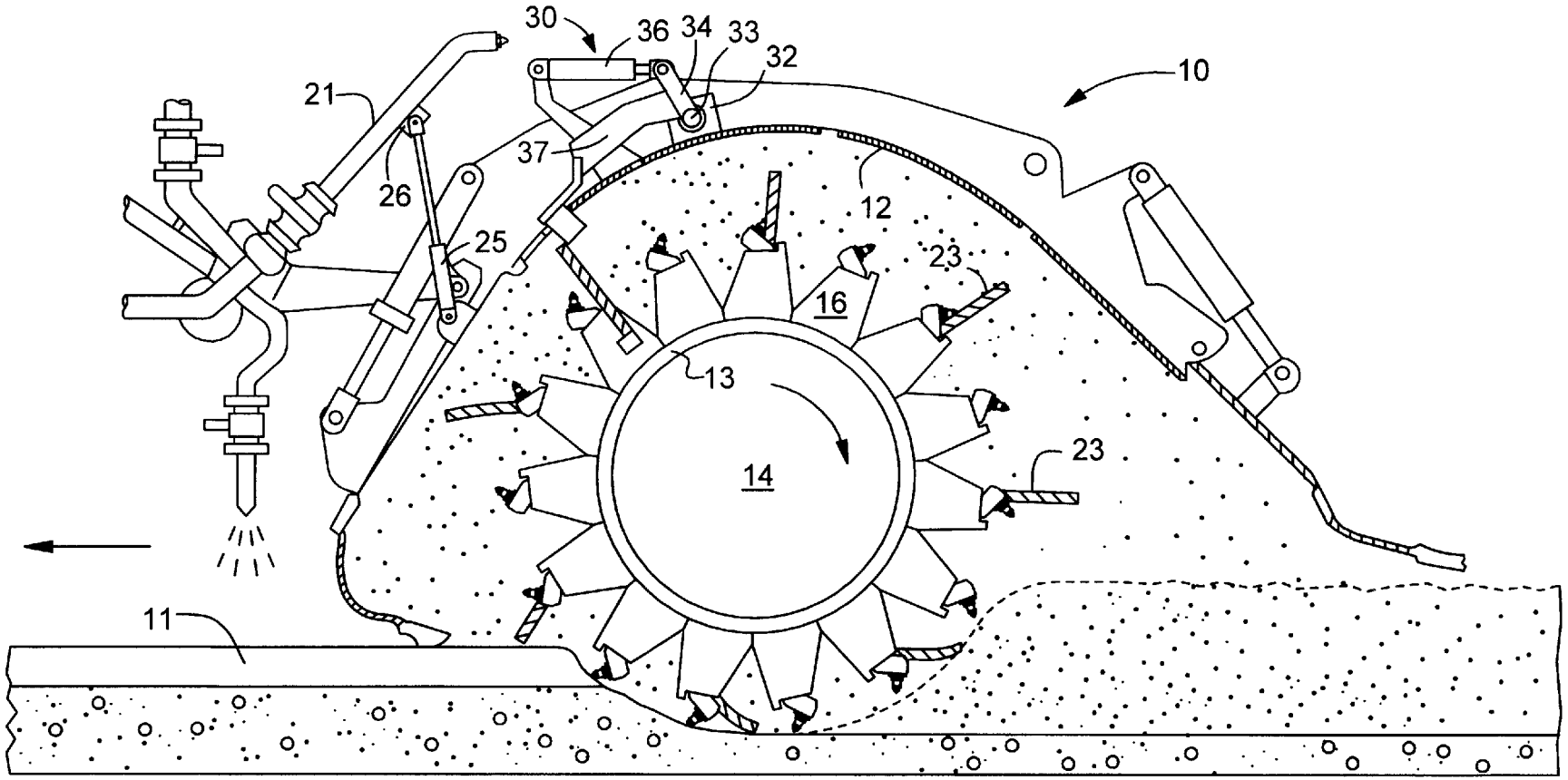
FIG. 2 is a schematic side view of the pulverizing chamber or assembly of a reclaimer/stabilizer machine in accordance with the present invention illustrating the engagement of the anti-bridging pocket members with the nozzle ports during operation of the reclaimer/stabilizer machine.

In FIGS. 1 and 2, the pulverizing assembly or apparatus 10 is schematically shown and is utilized to travel along a road bed 11 to pulverize the road bed during reclaimer/stabilizing operations. The pulverizing assembly 10 is a component of a machine for preparing a road bed, of a type described in U.S. Pat. No. 5,190,398. The pulverizing assembly includes a cutter housing 12 partially enclosing a cutter drum 14 having a cutter drum shell 13 extending about the radial periphery of the cutter drum 12. The cutter housing 12 is provided to confine the pulverization of the road bed 11 in accordance with the present invention. Mounted to the cutter drum shell 13 are a plurality of cutter tooth shanks or brackets 16 (FIG. 5) having cutter teeth 17 (FIG. 5) mounted thereon. The cutter teeth engage and pulverize the road bed 11 for treatment of the pulverized road bed. The construction and structure of the tooth brackets 16 and cutting teeth 17 are disclosed in detail in U.S. Pat. Nos. 4,139,381 and 4,335,921, each of which are assigned to CMI Corporation, Oklahoma City, Okla., the assignee of the present invention. In one embodiment of the present invention, the width of the cutter drum 14 is approximately eight feet and the diameter is approximately fifty inches.

Figure 3:
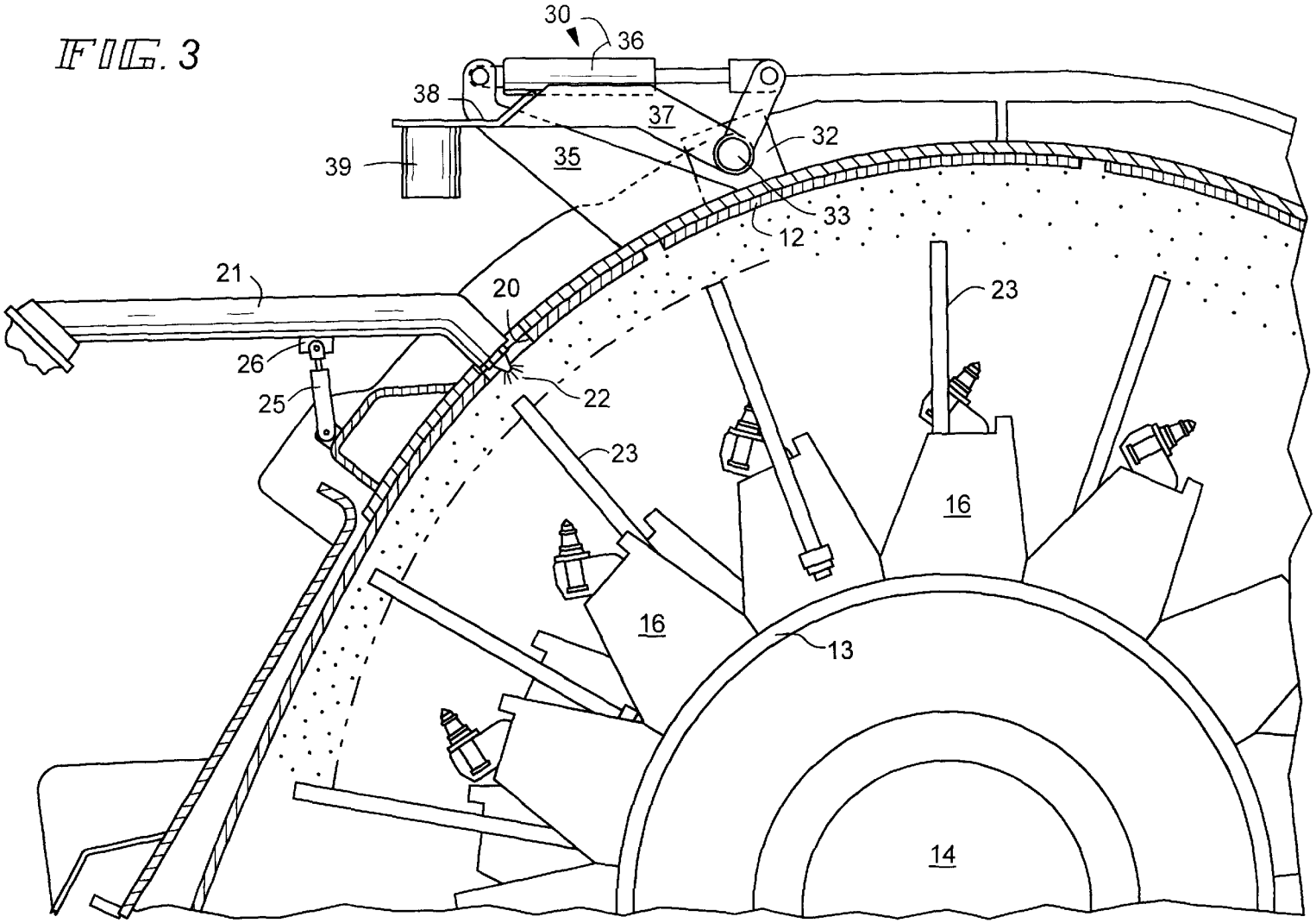
FIG. 3 is an enlarged portional view of FIG. 1 illustrating the injection of liquid material into the pulverizing chamber or assembly during operation of the reclaimer/stabilizer machine in accordance with the present invention.
Figure 4:
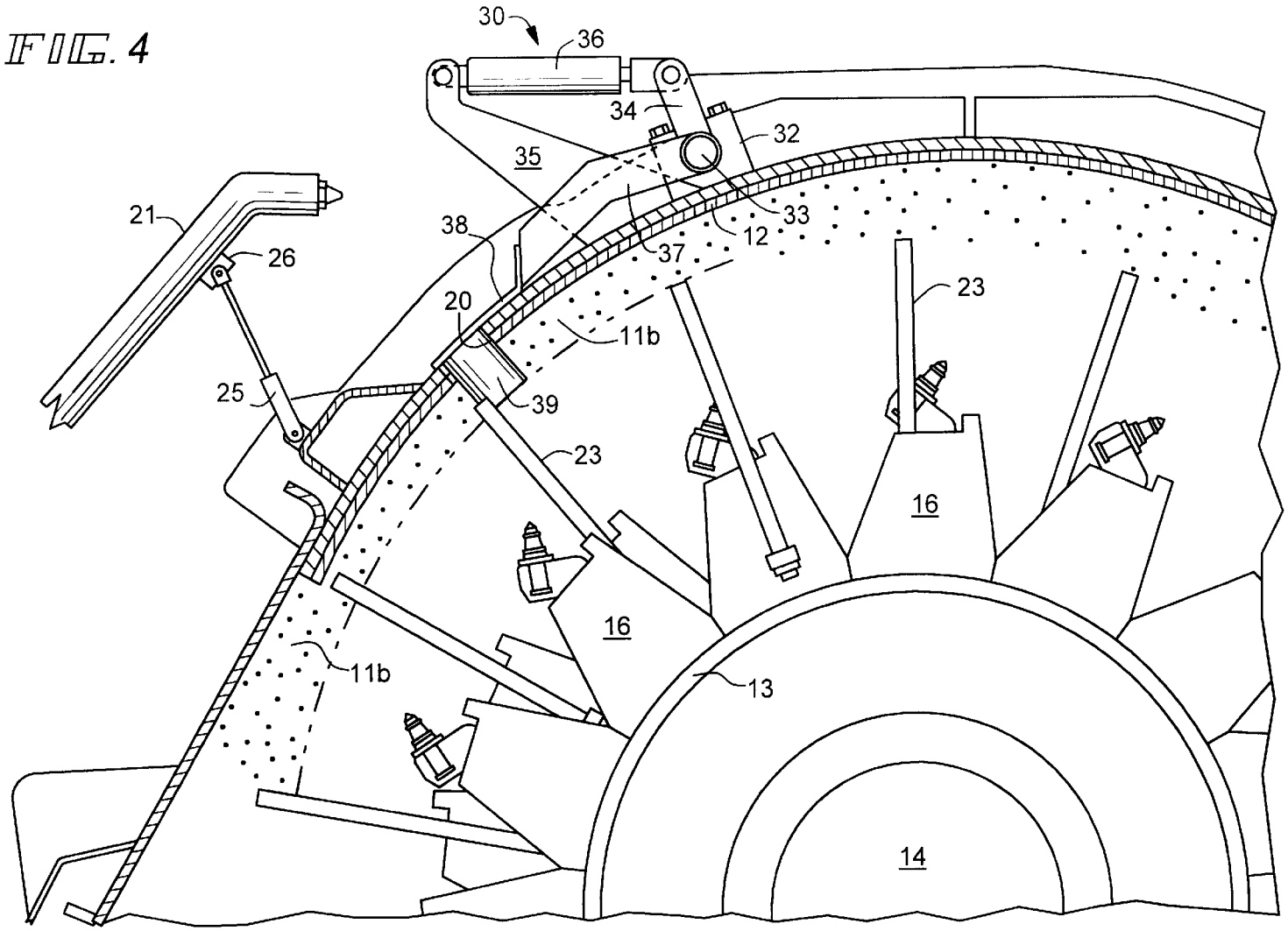
FIG. 4 is an enlarged portional view of FIG. 2 illustrating the engagement of the anti-bridging pocket members with the nozzle ports during operation of the reclaimer/stabilizer machine in accordance with the present invention.

During pulverization of the existing road bed 11, the pulverized material is directed in a counter clockwise manner about the rotating pulverizing or cutting assembly 10 to flow between the cutter drum 14 and the inside surface of the cutter housing 12. The centrifugal force of the rotating cutter drum tends to build-up the pulverized road bed material 11*b* against the inner housing surface during this processes of pulverization (FIG. 4). Periodically during pulverization, ganged spray nozzles 21 are structurally arranged and inwardly positioned to cooperate with the spray ports 20 which extend across the width of the cutter housing, to inject liquid material 22 into the cutter housing for treatment of the pulverized road bed (FIGS. 1 and 3). The ganged spray nozzles 21 are mounted to a support bar 26 which is attached to a spray nozzle cylinder 25 which is anchored to the cutter housing (best shown in FIG. 7). The ganged spray nozzles 21 are adapted to be pivotally moved from an outward disengaged position to an inward injecting position. When it is determined that sufficient liquid material 22 has been added to the pulverized road bed, the process illustrated in FIGS. 1 and 3, the spray nozzle cylinder 25 is energized to pivotally rotate the ganged spray nozzles away from the spray ports 21 to an outwardly disengaged position, the position as shown in FIGS. 2 and 4.

Figure 7:
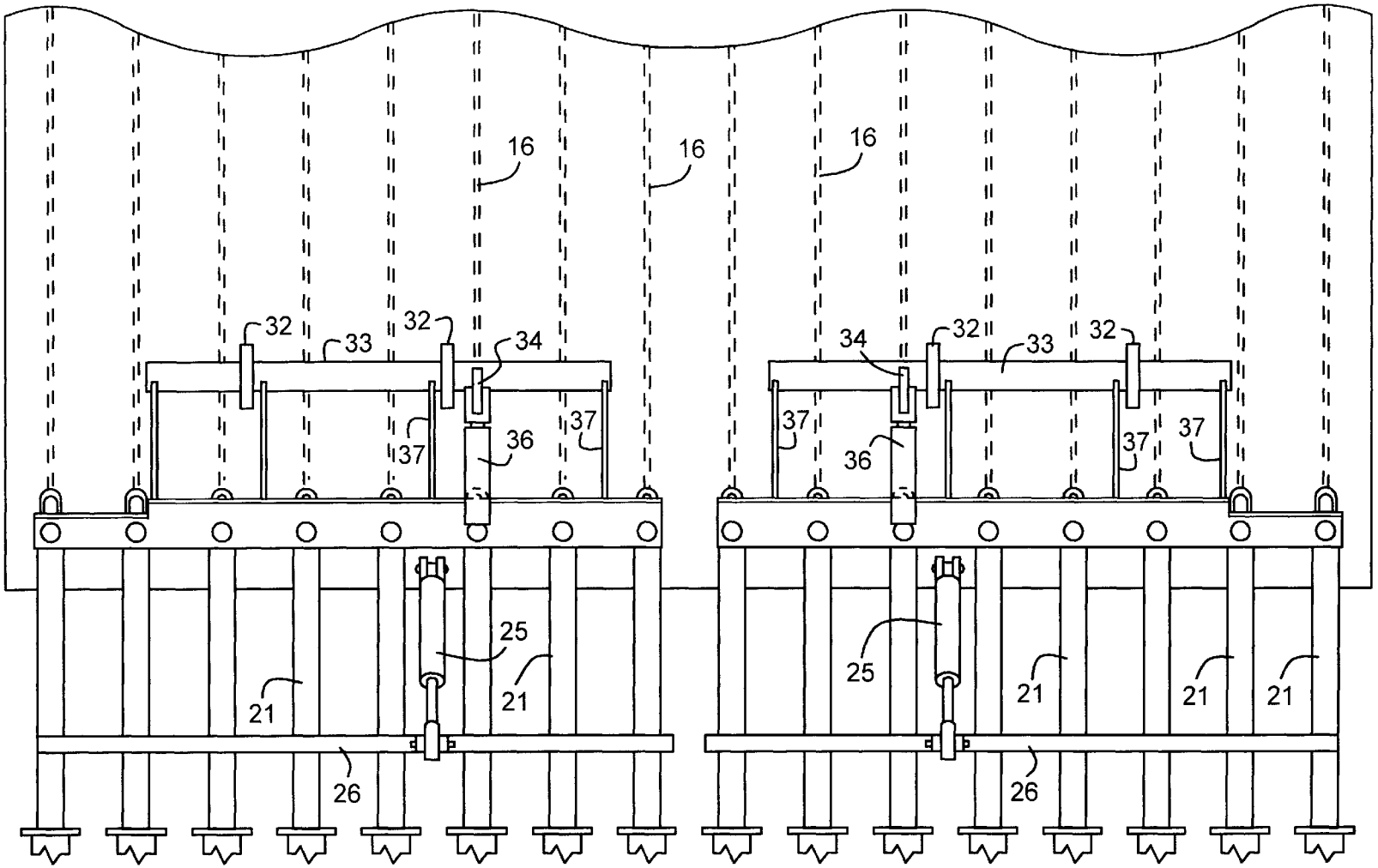
FIG. 7 is a partial top plan view of the pulverizing assembly illustrating the movement control apparatus of the ganged anti-bridging mechanism and of the ganged nozzle mechanism which both cooperate with the nozzle ports in accordance with the present invention.

When the spray nozzles 21 are located in the disengaged position, the anti-bridging or anti-clogging mechanism 30 in accordance with the present invention is energized. As shown in FIGS. 1, 3 and 7, the anti-bridging mechanism 30 is comprised of a pair of mounting support brackets 32 secured to the outer surface of the cutter housing, with a mounting tube or member pipe 33 rotationally supported by the brackets. The pipe member 33 includes an anchor member or arm 34 secured thereto. The anchor arm 34 and support member 35 provide a mounting for anti-bridging cylinder member 36. As shown in FIGS. 2, 4, 6 and 7, a plurality of anti-bridging arms 37 are secured to the pipe 33 and extend outwardly to the anti-bridging plate 38 for supporting anti-bridging pockets or cup members 39 (as shown in FIG. 6). When the anti-bridging cylinder member 36 is extended, the anti-bridging plate and pockets are in the upper disengaged position with respect to the spray ports 20, as shown in FIGS. 1 and 3. Upon actuation of the cylinder member 36, arm 34 rotates the pipe member and causes the anti-bridging plate 38 and anti-bridging pockets 39 associated therewith to rotate to engage and to fit into the spray ports 20 in the cutter housing. When the anti-bridging mechanism is fully rotated, the anti-bridging pockets or cups enter and snugly engage the spray ports 20. The engaged pockets 39 prevents build-up of the pulverized material within the nozzle port 21 during operation of the reclaimer/stabilizing machine. The pockets 39 have sealed ends 40 (FIG. 6) which prevent pulverized material from entering the spray ports 20.

When it is again desired to add liquid materials into the pulverizing chamber or housing, the anti-bridging cylinder 36 is energized to pivotally move the ganged bridging pockets from the engaging position to the disengaged position, the position as shown in FIGS. 1 and 3. After completion of the anti-bridging mechanism movement from the nozzle ports, the movement of the ganged spray nozzles from the disengaged to the engaged position occurs to permit liquid additives 22 to be sprayed into the cutter housing.

Figure 8:
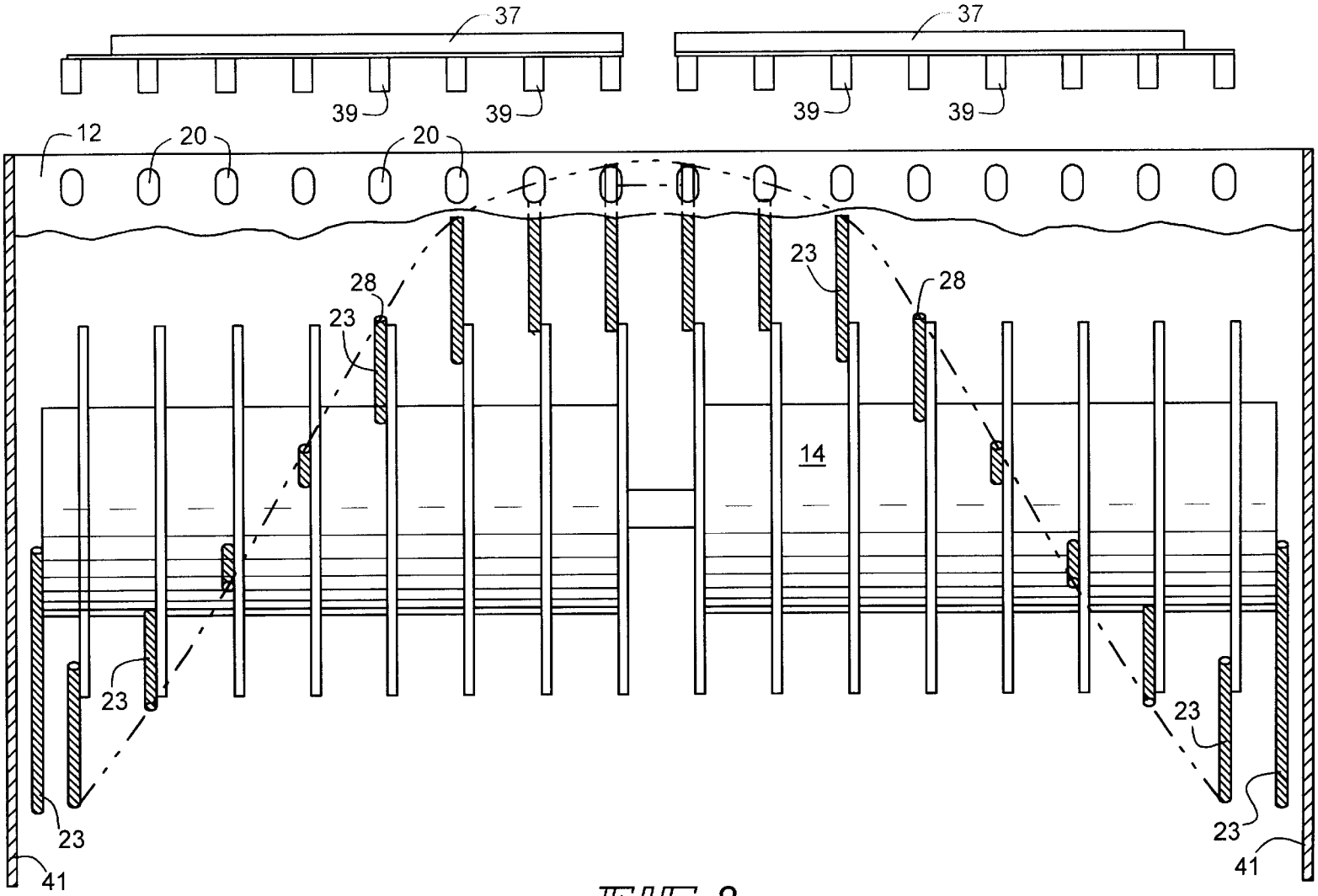
FIG. 8 is a schematic top plan view of the cutter drum assembly illustrating the mounting of the cable members onto selected cutter shanks or brackets in a helical pattern and the alignment of respective cable members with respective nozzle ports in accordance with the present invention.

As described above, it is contemplated that in one embodiment of the present invention that the cutter drum 14 has a width of eight feet. Accordingly, one acceptable structure for providing a uniform spray of the liquid additive to the pulverized road bed would be a structure wherein there are approximately sixteen spray ports 20 extending equal distance across the width of the cutter housing. These are best shown in FIG. 8. Also, as shown in FIG. 7 it is preferred that the anti-bridging or anti-clogging mechanism be ganged in sections of eight to properly permit engagement of the anti-bridging pockets within the corresponding spray ports. Also, it is preferred that the spray nozzles 21 are ganged together in groups of eight to simplify the movement of the spray nozzles between the inward engaged and outward disengaged position.

A further embodiment of the present invention includes a plurality of anti-bridging cable members 23 which are individually secured to the side of selected cutter shanks or brackets 16 that are mounted on the drum shell 13. As shown in FIG. 5, a cable member 23 is secured to the side of a selected tooth brackets 16 by the use of a retaining lug 24. The lower end portion of the cable which is engaged by the retaining lug 24 includes a plurality of washers 27 welded to the cable end to prevent the cable from pulling out of the retaining lug. The cables extend radially outwardly from the cutter brackets about the periphery of the cutter drum. Each individual cable 23 is adapted and positioned on a selected cutter bracket to be substantially in the same plane as the nozzle ports to pass by the ports during each revolution of the cutter drum.

In accordance with the previous discussion, the nozzle ports are spaced equally across the width of the cutter housing to provide, in one example of the invention, sixteen nozzle ports. The number of anti-bridging cables 23 that are mounted to the cutter brackets and which extend radially outwardly from the cutter drum is a total of sixteen cables. The cables are spaced about the cutter drum and each cable engages one of the anti-bridging pockets 39 that has been positioned into and engageable with the nozzle port during each revolution of the cutting drum. It is preferred that the cables are mounted in a helical pattern or array on the cutter drum on the cutter tooth brackets 16, as shown in FIG. 8.

As shown in FIGS. 1–2, the metal cables 23 are flexible and bend upon engagement with the road bed surface, as shown during the pulverization of the road bed surface 12. However, when the cables and attendant cutter teeth clear the road bed surface, the cables tend to straight out in a substantially linear fashion. As previously described, the cables are mounted to the cutter brackets and spaced about the cutter drum in a helical pattern or array such that each of the cables is mounted coincidentally with a corresponding nozzle spray port 20 to permit the individual cable to structurally cooperate and engage the single nozzle port and the sealed end 40 of the inserted anti-bridging pocket during each revolution of the cutter drum. Such engagement limits build-up of pulverized material within the housing and maintains the nozzle ports free and clear of material build-up.

While particular embodiments of the present invention have been shown and described, it will be obvious to those skilled in the art that changes and modifications may be made without departing from the invention in its broader aspects. For example, as shown in FIG. 6, the anti-bridging pocket is formed in a cylindrical shape having a closed sealed end 40. It is within the scope of the present invention that the anti-bridging pocket or cup member 39 may be tapered to facilitate engagement with the spray port 20. It is sufficient for the purposes of the present invention that the anti-bridging pocket be of such a structure to permit engagement into the spray port to prevent pulverized material from closing and blocking the spray port. Also, it is preferred that upon each revolution of the cable members on the cutter drum, that the end 28 of the cable 23 engage the end 40 of the anti-bridging pocket 39 in a swiping motion to prevent pulverized material build-up. Such interaction between the cable and the end 40 of the anti-bridging pocket 39 insures removal of the build-up of the pulverized material about the spray ports. As shown in FIG. 8, cables 23 may be mounted at each end of the cutter drum to remove pulverized material that may build-up along the end side walls 41 of the pulverizing assembly.

What is claimed is:

1. For use with a stabilizer machine for pulverizing a road bed, the machine having a rotating cutter drum, cutters mounted to the drum, a cutter housing enclosing a portion of the rotating cutter drum, a plurality of nozzle ports extending the width of the cutter housing and ganged spray nozzles operating between an actuated position wherein the nozzles cooperate with the nozzle ports to permit injection of liquid material in the cutter housing and an unactuated position wherein the ganged nozzles are disengaged from the nozzle ports, the improvement comprising: a anti-bridging mechanism structurally arranged to engage the nozzle ports to seal the nozzle ports from pulverized road bed material when the nozzles are in the unactuated position.

2. The machine in accordance with claim 1, wherein said anti-bridging mechanism includes pocket cups which are structurally arranged to engage and seal the nozzle ports.

3. The machine in accordance with claim 2, wherein said anti-bridging mechanism further includes a plurality of cable members, equal to the number of nozzle parts in the housing, each cable having a first end secured to the cutters of the rotating cutter drum, with each of said cables structurally arranged such that said second end of said cable cooperates with said anti-clogging mechanism engaged in the nozzle ports.

4. The machine in accordance with claim 3, wherein said cable members are positioned on the cutter drum in a helical array.

5. The machine in accordance with claim 4, wherein said helical array of said cable members are aligned to cooperate with said anti-bridging mechanism extending through the nozzle ports.

6. An anti-bridging apparatus for preventing the build-up of pulverized (road bed) material within a cutter assembly having a cutter drum and attached cutter rotating in a cutter housing and a plurality of nozzle ports the cutter housing of a road surface preparation machine comprising:

a mounting tube, fixedly secured to the exterior of said cutter housing;

an anti-bridging plate having a plurality of anti-bridging pockets, equal to the number of the nozzle ports, fixedly secured to said anti-bridging plate, whereby all said pockets are structurally arranged to snugly fit into the respective nozzle ports;

a plurality of arms with their first ends pivotally secured to said mounting tube and second ends fixedly secured to said anti-bridging plate;

an anti-bridging cylinder having a first end pivotally secured to said mounting tube, and a second end fixedly secured to the exterior of said cutter housing, whereas actuation of said cylinder positions and moves said bridging pockets between a first position wherein said pockets are away from said housing and ports and a second position wherein said pockets are engagable with the nozzle ports of said cutter housing.

7. The anti-bridging apparatus in accordance with claim 6 further including: a plurality of cable members, equal to the number of the nozzle ports in said cutter housing, each cable having a first end secured to the cutters on the rotating cutting drum, with each of said cables so positioned so that the second end of said cable engages one of said anti-bridging pockets when said pockets are positioned snugly inside the nozzle ports.

8. The anti-bridging apparatus in accordance with claim 6, wherein said cables are positioned in a helical array on and about the cutter drum.

9. The machine in accordance with claim 8, wherein said helical array of said cable members are aligned to cooperate with said anti-bridging mechanism extending through the nozzle ports.

* * * * *

UNITED STATES PATENT AND TRADEMARK OFFICE

CERTIFICATE OF CORRECTION

PATENT NO. : 6,149,342

DATED : November 21, 2000

INVENTOR(S) : John F. Phillips

It is certified that error appears in the above-indentified patent and that said Letters Patent is hereby corrected as shown below:

IN THE SPECIFICATION

| Column | Lines | |
|---|---|---|
| 1 | 47 | delete "addititive" and insert - additive -; |
| 4 | 21 | after having delete "a" and insert - an -. |

Signed and Sealed this

Eighth Day of May, 2001

*Attest:*

Nicholas P. Godici

NICHOLAS P. GODICI

*Attesting Officer*

*Acting Director of the United States Patent and Trademark Office*